US007028521B2

(12) United States Patent
Fan

(10) Patent No.: US 7,028,521 B2
(45) Date of Patent: Apr. 18, 2006

(54) PIPE FEEDING MECHANISM OF AN AUTOMATIC PIPE BENDER

(75) Inventor: Shih-Tzung Fan, Tainan (TW)

(73) Assignee: Chiao Sheng Machinery Co., Ltd., Tainan Hsien (TW)

( * ) Notice: Subject to any disclaimer, the term of this patent is extended or adjusted under 35 U.S.C. 154(b) by 226 days.

(21) Appl. No.: 10/683,707

(22) Filed: Oct. 14, 2003

(65) Prior Publication Data

US 2005/0076692 A1 Apr. 14, 2005

(51) Int. Cl.
*B21D 7/04* (2006.01)

(52) U.S. Cl. ..... 72/149; 72/307; 72/420

(58) Field of Classification Search ..... 72/149, 72/307, 420, 422; 74/813 L, 813 C, 52; 475/166, 169, 317, 282, 330, 337
See application file for complete search history.

(56) References Cited

U.S. PATENT DOCUMENTS 2,251,625 A * 8/1941 Hale ..... 475/123
4,765,168 A * 8/1988 Stange et al. ..... 72/159
5,343,725 A * 9/1994 Sabine ..... 72/155
5,685,796 A * 11/1997 Chen et al. ..... 475/320
6,605,019 B1 * 8/2003 Eckert ..... 475/299

* cited by examiner

*Primary Examiner*—Derris H. Banks
*Assistant Examiner*—Debra M Wolfe
(74) *Attorney, Agent, or Firm*—Rosenberg, Klein & Lee

(57) ABSTRACT

A pipe feeding mechanism includes a rack, a power source, first and second planetary gears, a clutch for releaseably securing an output shaft to an input shaft in the first planetary gear, and a brake for releaseably blocking rotation of a sun gear of the first planetary gear; the input shaft of the first planetary gear is connected to the power source; the first planetary gear will be stopped from functioning, and the output shaft thereof rotated at a same speed as the input shaft thereof during a return stroke of pipe feeding cycle after the clutch is switched to a clutching position, and the brake device a releasing position; the first planetary gear will be allowed to function together with the second planetary gear to increase output torque during a forward stroke after the clutch is switched to a releasing position, and the brake device a braking position.

6 Claims, 6 Drawing Sheets

PIPE FEEDING MECHANISM OF AN AUTOMATIC PIPE BENDER

BACKGROUND OF THE INVENTION

1. Field of the invention

The present invention relates to a pipe feeding mechanism of an automatic pipe bender, more particularly one, which can deliver great output force when feeding a pipe through a bending mechanism, and can move back to the initial position-at higher speed after it finishes feeding the pipe.

2. Brief Description of the Prior Art

Referring to FIGS. 4, and 5, a conventional pipe bender includes a main holding portion 10, a feeding mechanism 20 movable on the main holding portion 10, a power source (not shown), and a bending mechanism, which is comprised of a stationary arm 30, a movable arm 40, and an actuating shaft 401 connected with both the movable arm 40 and the power source. The feeding mechanism 20 is provided for feeding a pipe secured thereto through the bending mechanism, and the movable arm 40 will be displaced relative to the stationary arm 30 to bend the pipe by the power source after the pipe is held in position on the arms 30 and 40. The arms 30 and 40, and molds to be used together with the arms 30, 40 for bending a pipe are not the subject of the present invention therefore they are not detailed herein. The feeding mechanism 20 will move back to the initial position after it finishes feeding a pipe into the bending mechanism for allowing the next pipe feeding cycle to start.

Feeding mechanisms of pipe benders have to deliver great output force in feeding a pipe into bending mechanisms of pipe benders, and are usually equipped with planetary gears, through which great output force can be provided. Referring to FIG. 6, feeding mechanism 20 is movably supported on a main holding portion 10 (FIGS. 4, and 5) of a pipe bender, and comprised of a power source 201, and a planetary gear set 202. The planetary gear set 202 includes a fixed sun gear 204, an input shaft 2021 arranged in the sun gear 204 and securely connected with an output shaft 2011 of the power source 201, several planet pinions 2022, and a rotary shaft 203, and a gear 2031 secured to a lower end of the rotary shaft 203 and engaged with a rack 101 fixedly disposed on the main holding portion 10. The sun gear 204 has gear teeth on an inner side thereof. The planet pinions 2022 are rotary on respective shafts 2023 supported in position on the rotary shaft 203, and are engaged with both the input shaft 2021 and the toothed inner side of the sun gear 204; thus, when the input shaft 2021 is made to turn by the power source 201, the planet pinions 2022 will rotate on respective shafts 2023, and make circular motion around the input shaft 2021. Therefore, when the power source 201 functions, the rotary shaft 203 is turned owing to the circular motion of the planet pinions 2022, and in turns, the feeding mechanism 20 moves left and right along the rack 101 while the pushing force of the mechanism 20 is increased owing to the planetary gear set 202 functioning to reduce the speed.

The feeding mechanism 20 will push a pipe through a bending mechanism with increased force and reduced speed in the feeding stroke owing to the planetary gear set 202. However, the feeding mechanism will also move at the same speed during the back stoke due to the planetary gear set 202, and it's a waste of time because there is no need for the planetary gear set to function to increase the output force during the back stroke of the feeding mechanism 20. Consequently, efficiency of the pipe bender is reduced.

SUMMARY OF THE INVENTION

It is a main object of the present invention to provide a pipe feeding mechanism of an automatic pipe bender to overcome the above disadvantages.

The pipe feeding mechanism of an automatic pipe bender includes a fixed gear rack, a shell movable along the rack, a power source fixed to the shell, first and second planetary gears in the shell, a clutch for making an output shaft of the first planetary gear releaseably secured to an input shaft of the first planetary gear, and a brake for releaseably blocking rotation of a sun gear of the first planetary gear. The input shaft of the first planetary gear is connected to an output shaft of the power source. The first planetary gear will be stopped from functioning, and the output shaft thereof rotated at a same speed as the input shaft thereof during a return stroke of a pipe feeding cycle after the clutch is switched to a clutching position, and the brake device is switched to a releasing position. The first planetary gear will be allowed to function together with the second planetary gear to increase output torque during a forward feeding stroke after the clutch is switched to a releasing position, and the brake device is switched to a braking position. Thus, the pipe feeding mechanism can move at a higher speed during a return stroke than it does during a forward feeding stroke.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
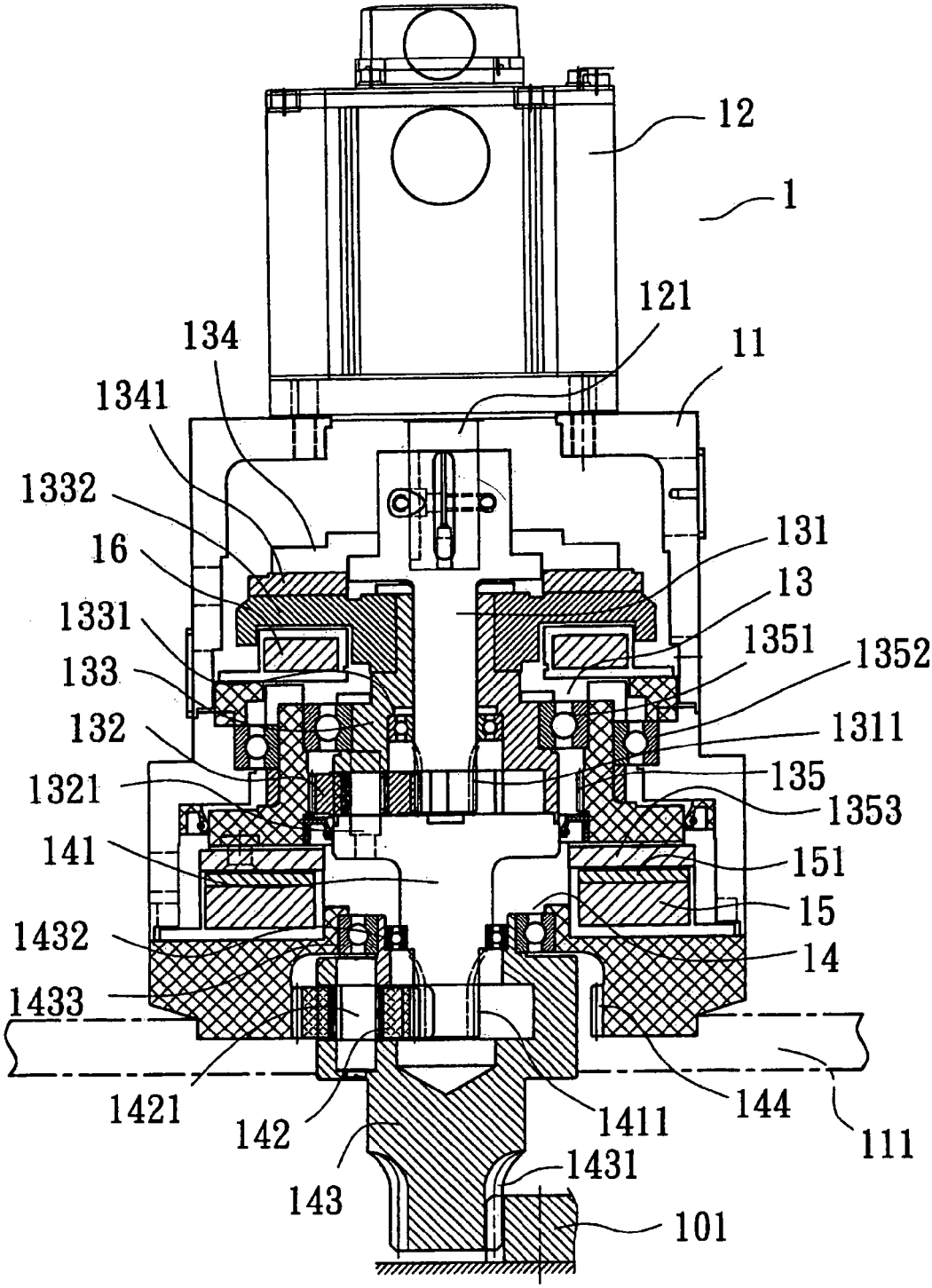
FIG. 1 is a vertical section of the pipe feeding mechanism of an automatic pipe bender according to the present invention.

Referring to FIG. 1, a preferred embodiment of a pipe feeding mechanism 1 of an automatic pipe bender of the invention is movably supported on a main holding portion, on which a gear rack 101 is fixed. The pipe feeding mechanism 1 includes a shell 11, a feeding base 111, a power source 12, a first planetary gear device 13, a second planetary gear device 14, a brake device 15, and clutch devices 16.

The shell 11 is fixedly disposed on the feeding base 111. The power source 12 is arranged on top of the shell 11 for delivering power to the planetary gear devices 13 and 14, and has a rotary output shaft 121.

The first planetary gear device 13 is arranged in an upper portion of the shell 11, and includes a central toothed shaft 131, several planet pinions 132, an upper rotary support 133, a fixing block 134, and an actuating gear 135. The central toothed shaft 131 is securely connected to the output shaft 121 of the power source 12 to be rotary together with the shaft 121 while the fixing block 134 is secured to the central toothed shaft 131. The central toothed shaft 131 has gear teeth 1311 around a lower end thereof. The actuating gear 135 is arranged around the central toothed shaft 131, and has gear teeth (not numbered) on an inner side. The planet pinions 132 are rotary on respective shafts 1321, which are supported in position on the upper support 133. And, the upper rotary support 133 is arranged in the shell 11 with the planet pinions 132 engaging the gear teeth 1311 of the central toothed shaft 131 as well as the gear teeth of the actuating gear 135. The planet pinions 132 will normally rotate on respective shafts 1321, and make circular motion around the central toothed shaft 131 when the central toothed shaft 131 is turned by the power source 12. Consequently, the upper support 133 is normally caused to turn by the circular motion of the planet pinions 132 when the power source 12 functions.

Furthermore, the upper rotary support 133 has a clutch seat 1332 secured thereto while the clutch devices 16 are arranged under two ends of the clutch seat 1332. The fixing block 134 has clutch plates 1341 secured to a lower side thereof to oppose the clutch seat 1332; thus, when the clutch devices 16 are in a clutching position, and when the actuating gear 135 is free to rotate, and when the power source 12 functions, the upper support 133 will be connected with the fixing block 134 to be directly turned through rotation of the central toothed shaft 131. And, when the clutch devices 16 are in a releasing position, and the actuating gear 135 is held still to function like a sun gear, and when the power source 12 is started, the upper support 133 will be caused to turn through circular movement of the planet pinions 132 around the central toothed shaft 131, i.e. the upper support 133 is rotated at reduced speed and with increased output torque.

A bearing 1331 is arranged between the central toothed shaft 131 and the upper support 133, and a bearing 1351 is arranged between the upper support 133 and the actuating gear 135 while a bearing 1352 is arranged between the actuating gear 135 and the shell 11; thus, the planetary gear device 13 can function more smoothly.

The second planetary gear device 14 is comprised of a central toothed shaft 141, several planet pinions 142, a lower rotary support 143, and a fixed sun gear 144. The central toothed shaft 141 is securely connected to the upper support 133 of the first planetary gear device 13 to be rotary together with the upper support 133. The central toothed shaft 141 has gear teeth 1411 around a lower end thereof. The fixed sun gear 144 is fixedly disposed around the central toothed shaft 141, and has gear teeth (not numbered) on an inner side. The planet pinions 142 are rotary on respective shafts 1421, which are supported in position on the lower support 143. And, the lower rotary support 143 is arranged such that the planet pinions 132 are engaged with the gear teeth 1411 of the central toothed shaft 141 as well as the gear teeth of the sun gear 144. Thus, the planet pinions 142 will rotate on respective shafts 1421, and make circular motion around the central toothed shaft 141 when the central toothed shaft 141 is turned together with the upper support 133 by the power source 12, and in turns, the lower rotary support 143 will rotate at a lower speed and with more output torque than the upper support 133. In addition, the lower rotary support 143 has gear teeth 1431 around a lower end, and is engaged with the rack 101 at the gear teeth 1431 thereof; thus, the pipe feeding mechanism 1 will move along the gear rack 101 when the power source 12 functions.

Furthermore, a brake plate 1353 is secured to a lower side of the actuating gear 135, and a brake device 15 is arranged under the brake plate 1353 of the actuating gear 135 with a brake plate 151 thereof facing the brake plate 1353; thus, the actuating gear 135 can be kept still when the brake device 15 is in the braking position. A bearing 1432 is provided between the central toothed shaft 141 and the lower support 143 while a bearing 1433 is provided between the lower support 143 and the fixed sun gear 144.

Figure 2:
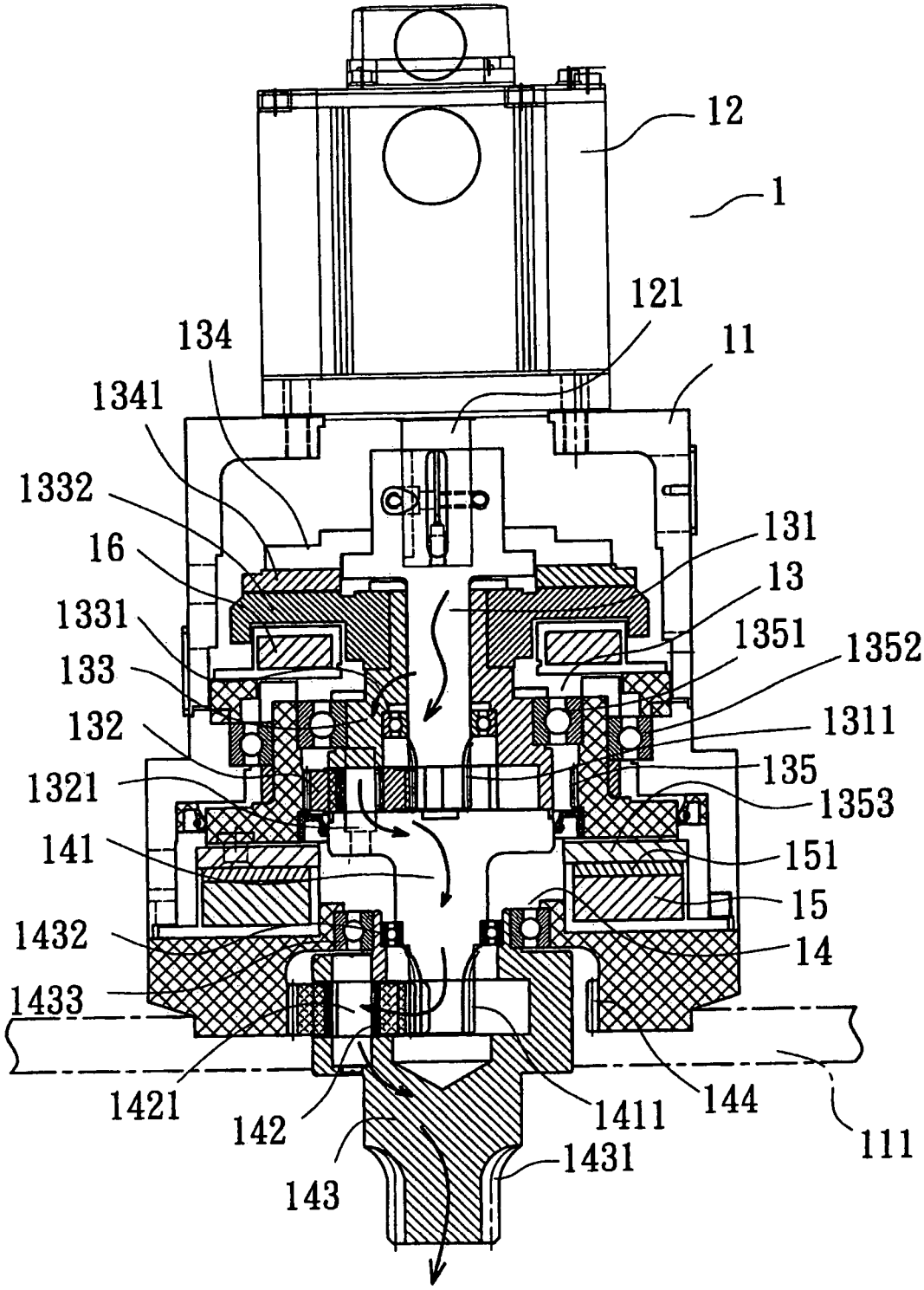
FIG. 2 is a vertical section of the pipe feeding mechanism of the present invention, functioning to transmit power from the power source (1)

To feed a pipe into the bending mechanism, the clutch device 16, and the brake device 15 are first switched to the releasing position, and the braking position respectively such that the actuating gear 135 is kept still to be capable of working as a fixed sun gear, and such that when the power source 12 functions, the upper support 133 of the first planetary gear device 13 will be made to rotate through circular movement of the planet pinions 132 around the central toothed shaft 131, and cause the central toothed shaft 141 of the second planetary gear device 14 to turn. Consequently, the lower support 143 of the second planetary gear device 14 is made to rotate with great torque through circular movement of the planet pinions 142 around the central toothed shaft 141, and the pipe feeding mechanism 1 can be moved at low speed and with great force along the gear rack 101 during the forward feeding stroke thereof, as shown in FIG. 2.

Figure 3:
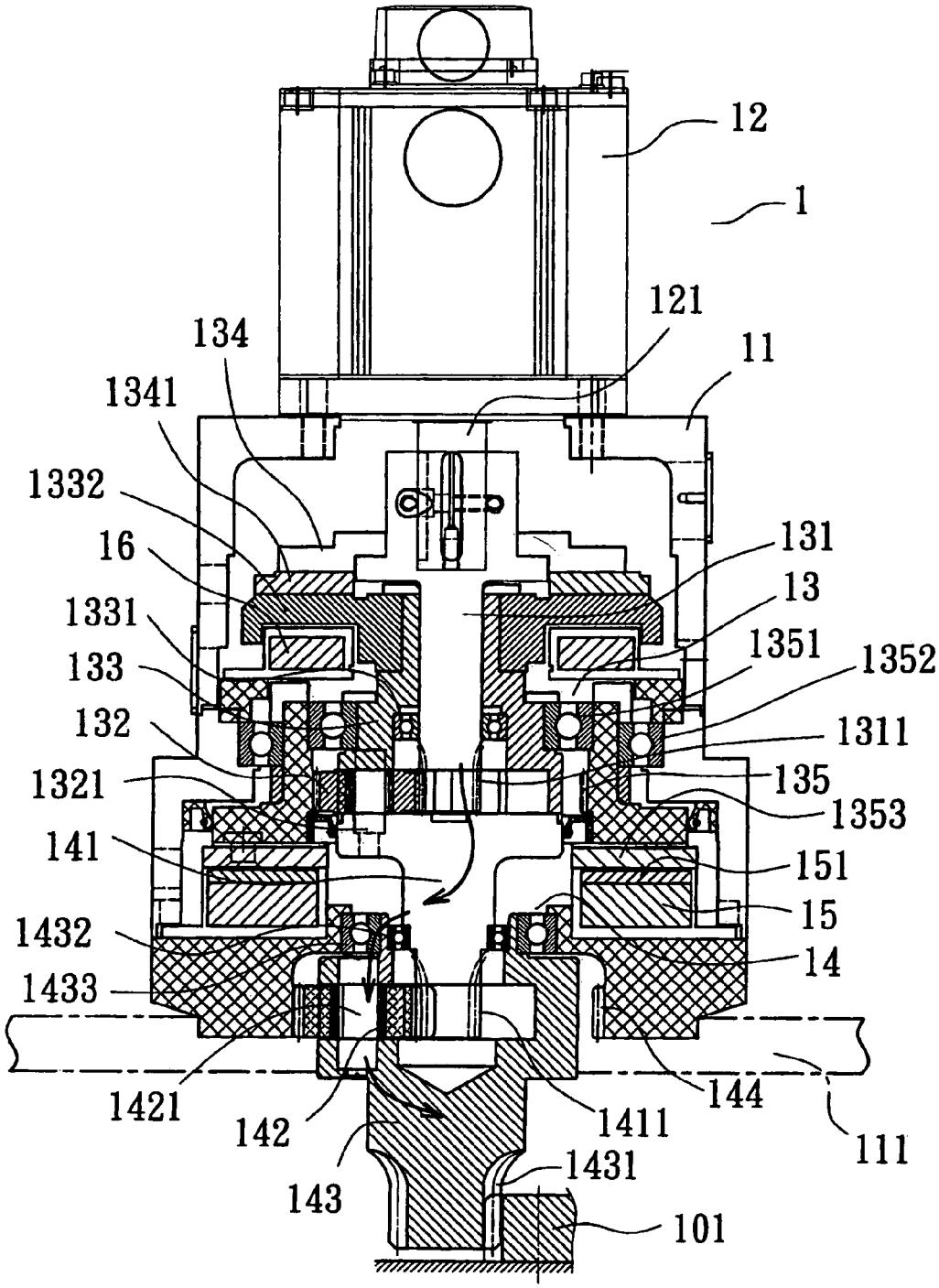
FIG. 3 is a vertical section of the pipe feeding mechanism of the present invention, functioning to transmit power from the power source (2)
Figure 4:
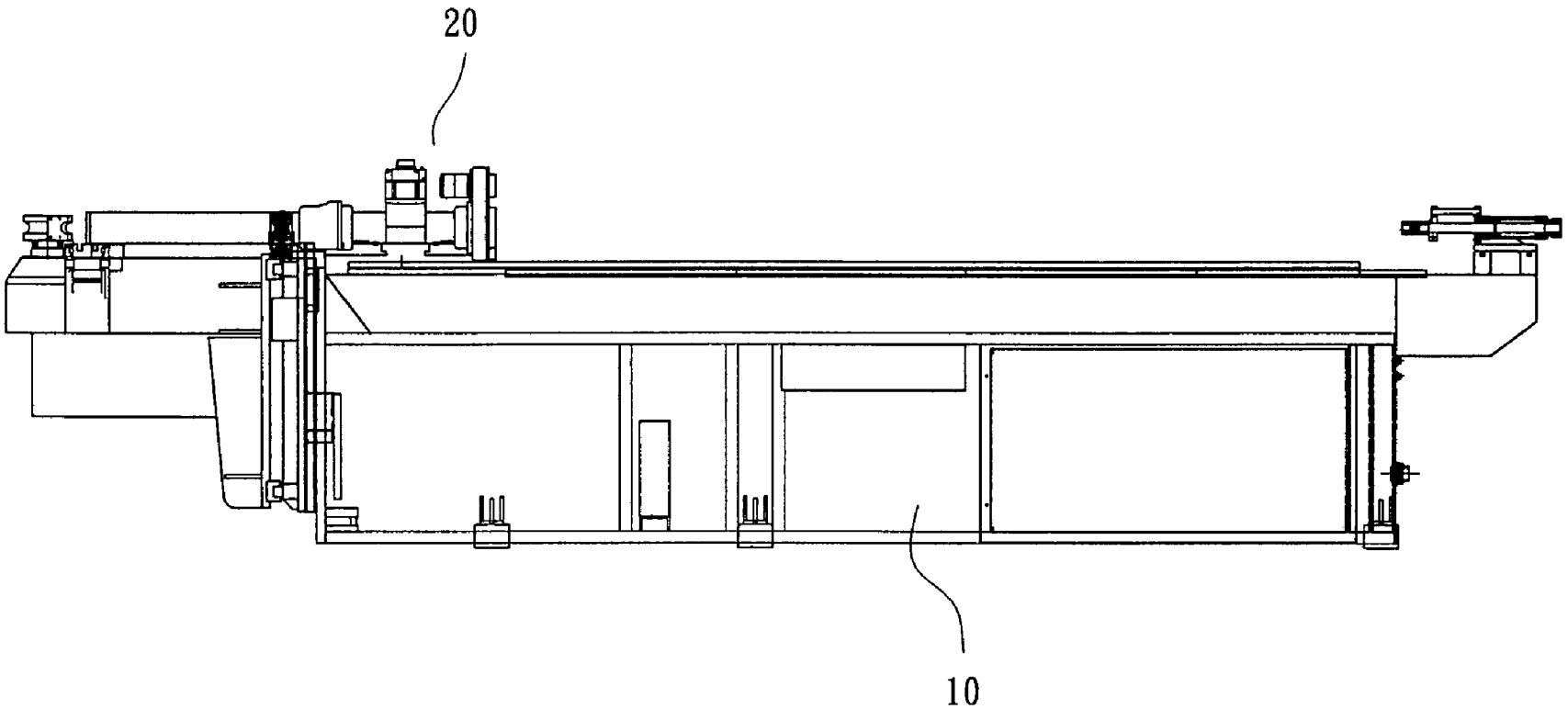
FIG. 4 (PRIOR ART)
FIG. 4 is a front view of the conventional pipe bender as described in the Background.
Figure 5:
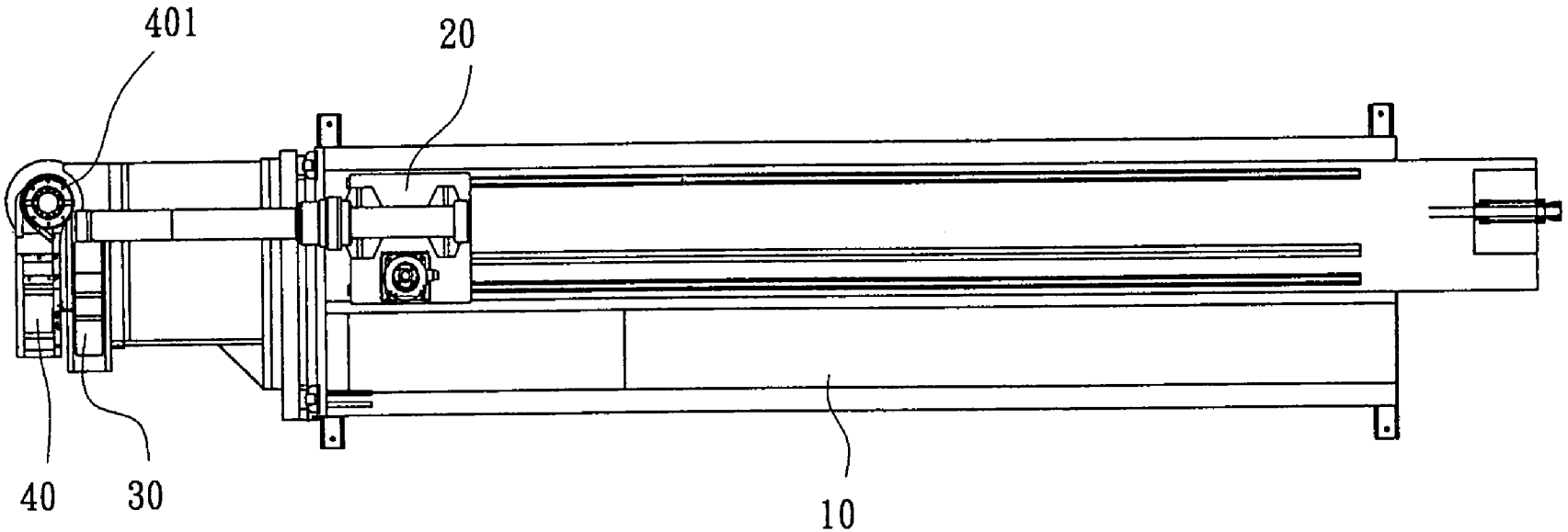
FIG. 5 (PRIOR ART)
FIG. 5 is a top view of the conventional pipe bender.
Figure 6:
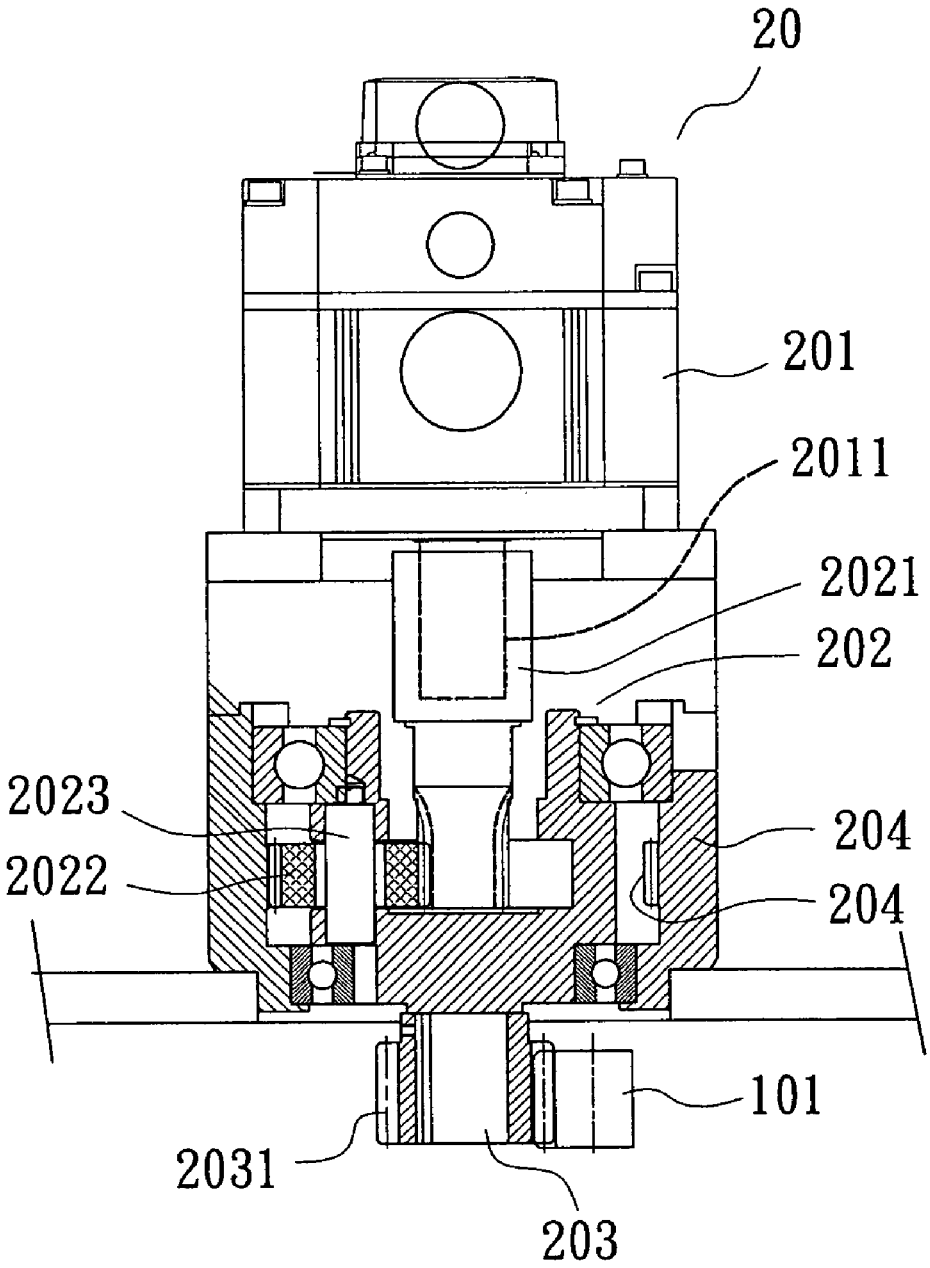
FIG. 6 (PRIOR ART)
FIG. 6 is a vertical section of the pipe feeding mechanism of the conventional pipe bender.

As soon as a pipe is fed into the bending mechanism, the clutch device 16, and the brake device 15 are switched to the clutching position, and the releasing position respectively such that the actuating gear 135 is free to rotate, and such that the upper support 133 is connected with the fixing block 134, and directly made to turn through rotation of the central toothed shaft 131. Therefore, the upper support 133 will be directly made to rotate through rotation of the output shaft 121 of the power source 12; in other words, the upper support 133 will rotate at a same speed as the output shaft 121, and output torque will not be changed when power is transmitted through the first planetary gear device 13. And, the upper support 133 causes the central toothed shaft 141 of the second planetary gear device 14 to turn, and output torque is increased after movement is passed on through the second planetary gear device 14; thus, the lower support 143 is made to rotate with a greater torque and at a slower speed than the upper support 133. Consequently, the pipe feeding mechanism 1 can move along the rack 101 at a higher speed during a return stroke, as shown in FIG. 3, than it does during a forward feeding stroke. In addition, the sun gear 144 and the planet pinions 142 of the second planetary gear device 14 can be made with such a gear ratio between them as to allow the pipe feeding mechanism 1 to move at a desirably higher speed during a return stroke.

From the above description, it can be seen that the force output can be significantly increased during a forward feeding stroke of the present pipe feeding mechanism through both the first and the second planetary gear devices 13 and 14 while the pipe feeding mechanism can move at higher speed during a return stroke thereof than it does during the forward feeding stroke after the clutch device 16, and the brake device 15 are respectively switched to the clutching position, and the releasing position, wherein the planetary gear device 13 is virtually made to not function like one.

What is claimed is:

1. A pipe feeding mechanism of an automatic pipe bender, comprising a shell movably supported above a main holding portion of a pipe bender;

a gear rack fixedly disposed under the shell on the main holding portion;

a power source fixed to an outer side of the shell; the power source having a rotary output shaft;

a first planetary gear device arranged in an upper portion of the shell; the first planetary gear device including:

(1) a central toothed shaft connected with the output shaft of the power source; the central toothed shaft having gear teeth around a lower end thereof; the central toothed shaft having a fixing block secured thereto;

(2) an actuating gear arranged around the central toothed shaft; the actuating gear having gear teeth on an inner side thereof;

(3) a plurality of planet pinions rotary on respective shafts and engaged with the gear teeth of the central toothed shaft and the actuating gear;

(4) an upper rotary support for supporting the shafts of the planet pinions thereon; and (5) a pair of clutch devices for releaseably securing the upper rotary support to the fixing block of the central toothed shaft so that upper support can be directly made to rotate by the central toothed shaft; the clutch devices being arranged under a clutch seat secured to the upper rotary support; and a second planetary gear device arranged under the first planetary gear device; the second planetary gear device including:

(1) a central toothed shaft connected with the upper rotary support of the first planetary gear device; the central toothed shaft having gear teeth around a lower end thereof;

(2) a fixed sun gear fixedly disposed around the central toothed shaft; the sun gear having gear teeth on an inner side thereof;

(3) a plurality of planet pinions rotary on respective shafts and engaged with the gear teeth of the central toothed shaft and the sun gear;

(4) a lower rotary support for supporting the shafts of the planet pinions thereon; the lower rotary support having gear teeth around a lower end thereof the toothed lower end of the lower rotary support being engaged with the gear rack;

(5) a brake device for releaseably blocking rotation of the actuating gear of the first planetary gear device so that the actuating gear can function as a sun gear;

thereby being capable of making the first planetary gear device stop functioning, and the upper rotary support rotated at a same speed as the central toothed shaft of the first planetary gear device during a return stroke of a pipe feeding cycle after the clutch devices are switched to a clutching position, and after the brake device is switched to a releasing position, and thereby allowing the first planetary gear device to function together with the second planetary gear device to increase output torque during a forward feeding stroke of a pipe feeding cycle after the clutch devices are switched to a releasing position, and after the brake device is switched to a braking position.

2. The pipe feeding mechanism of an automatic pipe bender as claimed in claim 1, wherein a bearing is arranged between the central toothed shaft and the upper rotary support of the first planetary gear device.

3. The pipe feeding mechanism of an automatic pipe bender as claimed in claim 1; wherein the fixing block of the first planetary gear device has a plurality of clutch plates secured to a lower side thereof.

4. The pipe feeding mechanism of an automatic pipe bender as claimed in claim 1, wherein a bearing is arranged between the upper rotary support and the actuating gear of the first planetary gear device while another bearing is arranged between the actuating gear and the shell.

5. The pipe feeding mechanism of an automatic pipe bender as claimed in claim 1, wherein a brake plate is secured to a lower side of the actuating gear of the first planetary gear device while each of the brake devices has a brake plate opposing the brake plate of the actuating gear.

6. The pipe feeding mechanism of an automatic pipe bender as claimed in claim 1, wherein a bearing is provided between the central toothed shaft and the lower rotary support of the second planetary gear device while another bearing is provided between the lower rotary support and the fixed sun gear.

* * * * *